United States Patent [19]

Keller

[11] 4,146,366

[45] * Mar. 27, 1979

[54] METHOD OF REMOVING GANGUE MATERIALS FROM COAL

[75] Inventor: Leonard J. Keller, Dallas, Tex.

[73] Assignee: The Keller Corporation, Dallas, Tex.

[ * ] Notice: The portion of the term of this patent subsequent to Jun. 21, 1994, has been disclaimed.

[21] Appl. No.: 853,031

[22] Filed: Nov. 21, 1977

[51] Int. Cl.[2] ..... C10L 9/10; B02C 19/00

[52] U.S. Cl. ..... 44/1 R; 44/1 G; 241/1; 241/23

[58] Field of Search ..... 44/1 R, 1 B, 1 G; 208/8; 241/1, 23

[56] References Cited

U.S. PATENT DOCUMENTS

| | | | |
|---|---|---|---|
| 1,679,857 | 8/1928 | France | 241/1 |
| 3,250,016 | 5/1966 | Agarwal | 241/23 X |
| 3,815,826 | 6/1974 | Aldrich et al. | 241/1 |
| 3,991,943 | 11/1976 | Rohrbach | 241/1 |
| 4,030,893 | 6/1977 | Keller | 44/1 B |

*Primary Examiner*—Carl Dees

*Attorney, Agent, or Firm*—Wofford, Fails & Zobal

[57] ABSTRACT

A method of removing gangue materials from coal characterized by the steps of comminuting and sizing all of the material to have most particles of a size smaller than one hundred microns; slurrying in an alcohol containing 1 to 4 carbon atoms; thereafter separating by settling velocity separation into an overflow stream containing most of the valuable coal products for storage as a fuel or the like and an underflow containing the gangue materials with some larger sized coal particles; thereafter diluting the underflow with alcohol and separating by settling velocity separation or the like into an overflow stream containing the coal for storage and an underflow containing mostly gangue material with some coal particles; separating the alcohol from the gangue materials and returning the alcohol to the process. The gangue materials can be employed as a fuel if they contain enough of the entrained coal particles.

Preferably, the comminution to effect mostly particles smaller than 100 microns is effected by a multi-step process including crushing and screening to drying size; drying; and separating into top and bottom streams, the hot latter being sent to a thermal-chemical reactor employing cool alcohol and thermal shock to effect partial comminution; and further comminution to effect the particle sizes less than 100 microns.

Also disclosed are specific details of the process to effect a low cost non-polluting carbonaceous fuel, feed stock or hydrocarbon fuel extender.

18 Claims, 2 Drawing Figures

METHOD OF REMOVING GANGUE MATERIALS FROM COAL

BACKGROUND OF THE INVENTION

1. Field of the Invention

This invention relates to a method of achieving an improved carbonaceous fuel composition. More particularly, this invention relates to an improved method of removing gangue materials from coal to form a low-sulfur, low-ash carbon fuel that burns readily with high efficiency and low pollution emissions.

2. Description of the Prior Art

The prior art has seen development of many and varied processes for treating coal for different purposes. Typical of these processes are those described in issued U.S. patents such as the following: U.S. Pat. Nos. 2,133,280 describing preparation of mineral oil products by extraction of coal; 3,748,254 describing the conversion of coal by solvent extraction; 3,754,876 describing the upgrading of coal by heating lumps to pyrolysis temperatures of up to 1000° F. (Farenheit) in an inert hydrogen-poor hydrocarbonaceous heat transfer fluid; 3,856,658 directed to slurried solids in hydrogenation of coal and 3,920,418 directed to converting the coal to a liquid and gaseous fuel employing solvent extraction followed by carbonization of the solids-rich fraction to char, that is finally gasified.

Despite the large number of processes for producing cleaner burning coal and producing cleaner more reactive feed stocks for coal conversion processes, there still exists a great need for such processes. From a pragmatic point of view, there is a particularly urgent need for processes to accomplish the foregoing economically and with higher efficiencies from the energy consumption standpoint.

The closest prior art of which I am aware is my priorly issued U.S. Pat. No. 4,030,893, entitled "Method of Preparing Low-Sulfur, Low-Ash Fuel," issued June 21, 1977; and the descriptive matter of that patent is embodied herein by reference for details omitted herefrom. That patent described and claimed an economical means for removing relatively large grains of diluent gangue materials (ash-forming and inorganic-sulfur-bearing mineral grains) from coals after comminution by conventional means and screening to minus 8 mesh size, with the majority of the material being minus 100 mesh size. In that patented process, the coal was comminuted in the presence of alcohols either before or after final sizing and the dilute slurry of the coal and alcohols, with various chemical compounds in the solution and with colloidal particles in suspension, was then subjected to a series of settling velocity separation steps to remove the higher settling velocity particles from the lower settling velocity particles. The gangue materials that were freed were freed as discreet particles and remained sufficiently large in size to exhibit relatively high settling velocities resulting from the size, higher density and particle sphericity (roundness) so as to be effectively separated from the lower settling velocity carbonaceous material. The carbonaceous material tends to break down to smaller sizes than the more durable gangue materials. That patent also described additional process steps such as the flashing to produce highly reactive puffed coal particles and the like. The patented process provided economical and useful means for reducing the ash-forming and inorganic sulfur-bearing mineral content of carbonaceous fuels; but was applicable only to those coals or lignites wherein the diluent, or gangue materials, exist within the coal or lignite as grains, or particles, larger than about 30 to 50 microns in size, with the minimum size removable depending upon the density and particle shape factors.

Consequently, although the prior inventions; particularly, the latter; were useful advances, they were limited in breadth of applicability. Moreover, the latter also required significant amounts of alcohols to be left in the carbonaceous particulate fuel. The rapidly escalating costs for the alcohols made this undesirable economically, even though it did improve the fuel quality and combustion characteristics.

Despite all the prior improvements, further advances are needed to provide for removal of much smaller particles of diluent, or gangue materials; to effect substantially complete recovery of the alcohols used in the process; and to effect removal of some of the organic sulfur-bearing compounds from the fuel end product, particularly where it is a carbon-hydrocarbon (CHC) fuel.

SUMMARY OF THE INVENTION

Accordingly, it is an object of this invention to provide a method of removing gangue materials from coal that removes even the small particles; that recovers substantially all of the alcohols used in the process and that removes organic sulfur-bearing compounds from the fuel end product.

It is a specific object of this invention to provide a method of forming a coal product that accomplishes all of the objectives set forth in the foregoing object and is universally applicable to all coals from lignite through anthracite.

These and other objects will become apparent from the descriptive matter hereinafter, particularly when taken in conjunction with the appended drawings.

In accordance with this invention there is provided a method of removing gangue materials from coal by comminuting and sizing the coal to form particle sizes of coal and gangue material mostly minus 100 microns size; forming a slurry of the coal and gangue materials in alcohol and separating by velocity settling methods the slurry into an overflow containing principally high quality particulate coal and sending it to storage and into an underflow containing high settling-velocity gangue materials that are in thickened slurry fluid containing some low settling velocity particles; diluting the underflow and selectively comminuting to break down the coarse coal with relatively little breakage of the smaller gangue material; separating the diluted underflow into an overflow containing a high quality coal product that can be sent to a storage tank and an underflow of unwanted gangue material containing a small percent by weight of high-density coal, fine carbon and the alcohol; and recovering the alcohol from the unwanted gangue materials and any coal that it contains.

In a preferred embodiment of this invention, the coal is comminuted to the minus 100 micron size by the steps of:

a. comminuting the coal by physical impaction, screening the coal and recycling the oversize to provide particulate coal no larger than about $\frac{3}{8}$ inch particle sizes; simultaneously forming fine coal and fine platy gangue material in the 1 to 20 micron particle size range;

b. drying the particulate coal by an undraft of hot gases that entrains the particulate coal, heats it to an elevated temperature and carries it as an overhead stream;

c. separating the overhead stream into a top stream containing the hot gases, the fine coal and the platy gangue material and a bottom that comprises the hot, dried particulate coal at its elevated temperature. The, top, or second overhead, stream has the fine coal and platy gangue material separated from the gas and used as a fuel for producing the hot gases to dry the coal in accordance with step b. If desired, the effluent gases may be treated by suitable steps, such as scrubbing, to remove sulfur-containing gases and the like. The hot dry coal, in the bottom, at its elevated temperature is then admixed with cool alcohol in an enclosed container called a thermal-chemical reactor, to provide thermal shock by contact of the hot coal with cool alcohol. The alcohol contains 1 to 4 carbon atoms. Carbon dioxide is evolved from the coal particles within the reactor to assist in the thermal and chemical breakage of the particles as will be described in more detail hereinafter. Thereafter, the coal is selectively comminuted in an enclosed comminutor to form mostly particles of less than 100 micron size. If desired, with certain coals, the product from the comminutor can be screened and coal of from about minus ⅜ inch to plus 1/20 inch or thereabout can be separated as a special product of high quality coal for special purposes. Herein, the terms "minus" will be employed to mean of a size smaller than or passing through an opening of the designated size; and the term "plus" is employed to mean that it will be retained on a screen of, or not pass through, an opening of the designated size. In the smaller sizes of minus 100 microns and less, the separations are effected by adjusting conditions on cyclones, centrifugal separators, or other settling velocity separation equipment. Consequently the separation is less precise than where screening is practical. It is for this reason that the term "most" is used herein to mean substantially all. Repeated sequences of selective comminution of the underflow stream from differential settling velocity separation, followed again by settling velocity separation of the underflow stream results in concentration of the low terminal settling velocity particles and colloidal size particles in the product dilute slurry, and concentration of the gangue materials, which are typically higher density and less irregular in shape, into the last underflow stream.

DESCRIPTION OF PREFERRED EMBODIMENTS

Figures 1, 2:
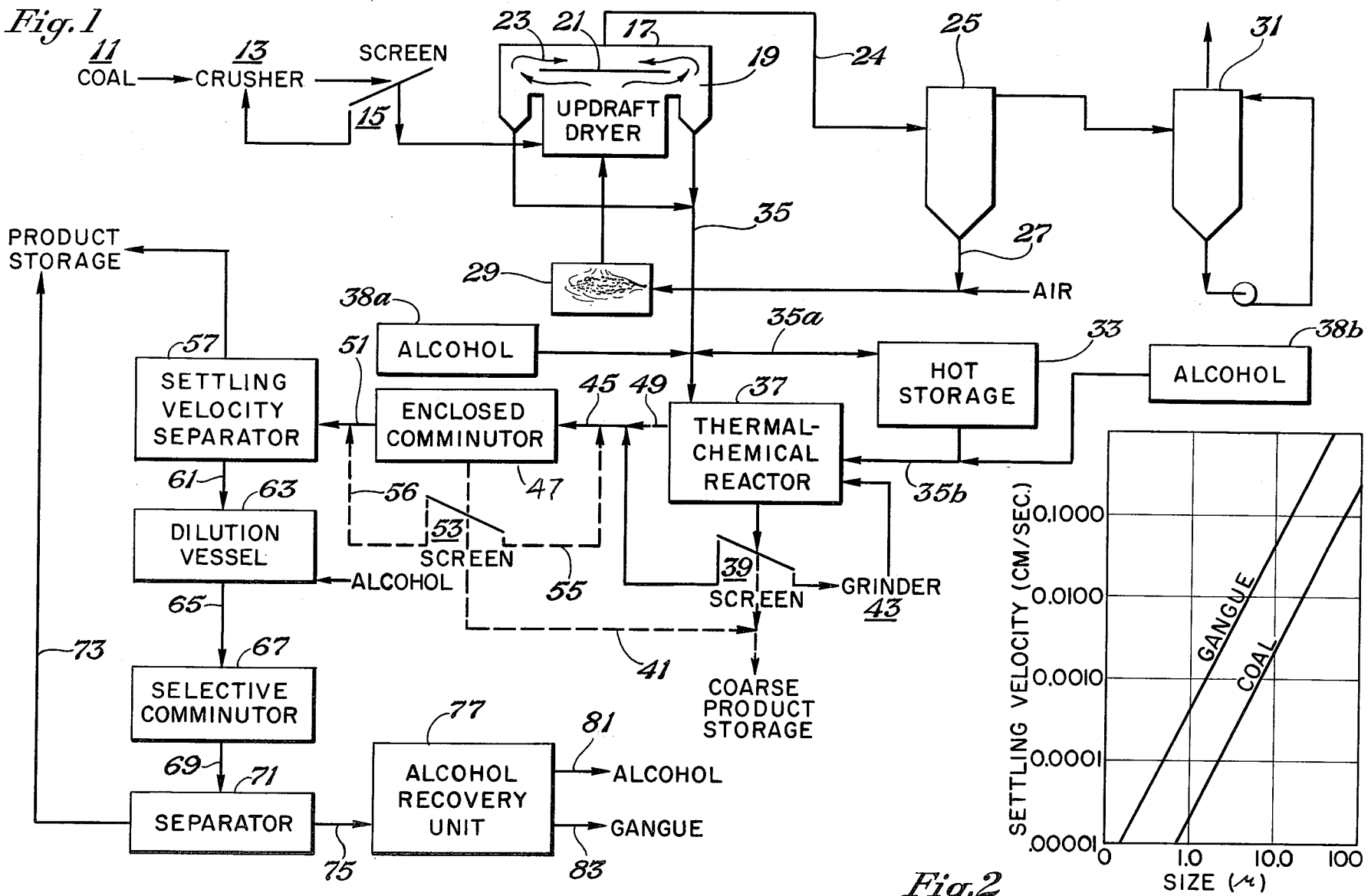
FIG. 1 is a flow diagram of one embodiment of this invention.
FIG. 2 is a graphical presentation showing the relative settling velocities of the gangue material and the coal for a specific size range materials, or particle sizes.

The coal that is employed in this invention may be any of the commercially available coals, ranging from the relatively pure and high carbon content anthracite coal through the bituminous coals to and including the less desirable soft coal, lignites and the like.

The mining and preparation of coal is described in the aforementioned U.S. Pat. No. 4,030,893, as well as in standard references texts such as Kirk-Othmer ENCYCLOPEDIA OF TECHNOLOGY, second edition, Anthony Standin, editor, Inter-Science Publishers, New York, 1969, volume 5, pages 606–676; and the descriptive matters of these references is incorporated herein by reference. The coal is mined from a coal mine by either strip or underground methods, as appropriate to the respective deposit. These methods are conventional and are described in the aforementioned references so need not be described in detail herein.

The preparation of the coal is described at page 661 in the above referenced Kirk-Othmer ENCYCLOPEDIA. One advantage of this invention is that it can employ the fines of the coal that were formerly discarded because of customer objections to fine coal and the loss of coal dust in loading and unloading. As described in U.S. Pat. No. 4,030,893, certain coals are highly friable and are readily comminuted with relatively low power requirements.

Referring to FIG. 1, the raw material comprising primarily coal with minor amounts of gangue material, and the like; and labeled "coal" is sent to a suitable crusher for reduction to a size of less than ⅜ inch maximum dimension. The initial crushing and grinding is preferably done with impact mills such as counter-rotating cage mills or hammer nails in order to take maximum advantage of the natural tendency of impact shock forces to separate the material along joining planes, faulted surfaces, solution channels and the like. The reason for this preferred impaction type of crushing is to free as much of the small particle-size platy gangue materials as possible from the coal particles. Particularly, it is desired to free as much of the gangue materials which are of the clay minerals clasification as can be done. These clay minerals are platy in shape and often very small in size. Consequently, they may be removed, if freed as discrete particles, along with the dryer exhaust gases which will also contain most of the very small coal particles. This low-grade fine coal may be used as dryer fuel as described hereinafter. Much of the clay mineral type of gangue materials in coals is often concentrated along joining planes in the coal structures and in solution channels, fault planes and stratigraphic partings. These areas of deposition represent points of weakness in the coal structures, and high impact type breakage tends toward freeing of the gangue materials as discreet particles. The raw material 11 comprising the coal and gangue material is sent from the crusher 13 to screen 15. The larger size particles will not pass through the screen 15 of ⅜ inch opening size and is recycled to the crusher 13.

The crushing and screening may be carried out by any of the conventional methods. They are well described in issued patents and published texts. These methods need not be described in detail herein.

Particles of coal and gangue material that are smaller than about ⅜ inch and pass through the screen 15 are sent to the updraft dryer.

The updraft dryer 17 is a dryer in which hot gas is fed into the bottom to entrain and carry the particles of coal and gangue material upwardly while simultaneously drying them. Typified by the updraft dryer 17 is the Parry dryer. The particles of coal and gangue material are carried over a dividing wall into a hopper 19. As implied from FIG. 1, the hopper 19 extends circumferentially about the periphery of the inner updraft tube of the updraft dryer 17. Consequently, when the gas flows outwardly around the baffle plate 21, as indicated by arrows 23, the particles of coal and gangue material larger than about 10 to 20 microns will settle in the quiescent zone and downwardly in the hopper 19.

During the traverse of the coal particles and the gangue particles in the rising current gas entrainment type of dryer, the particles are dried substantially completely, or to approximately zero moisture content as determined by conventional analytical methods. By removing substantially all of the water is meant drying the coal to a moisture content below one or two percent by weight of the coal. If desired, any other moisture content up to about the practical limiting range of 6 to 8 percent by weight can be employed. The dryer the coal the more nearly complete will be the shrinkage or swelling and breakage of the coal particles from the particles of gangue material. Specifically, the drying of the coal substantially completely tends to effect separation of dissimilar materials at the joining planes. Many coals undergo significant physical shrinkage as the last few percentage points of moisture are removed. This results in a peeling off of the carbonaceous material surfaces from the gangue materials that do not undergo shrinkage. This assists in removal of the gangue materials from the coal. Moreover, the rising gas flow will entrain the small particle size, ash-forming minerals such as clay minerals that have been freed from the coal by the impact shock forces during crushing and screening to the relatively small particle sizes prior to drying. Concentrating such gangue material into this relatively small stream that will be employed for dryer fuel, as can be seen from the following descriptive matter, is very beneficial, since it effects a reduction of diluents in the coal product. In addition, with some coals significant amounts of sulfur-bearing mineral grains will also be removed in this manner. The rising current, entrainment dryer also will effect some oxidation of sulfur-bearing minerals and organic material and, subsequently, some reduction in sulfur content of the carbonaceous fuel.

In any event, the overhead stream containing the hot gases, finely divided clay particles, sulfur-bearing mineral particles and oxides of sulfur will pass via conduit 24 to a separator 25.

Separator 25 is preferably a cyclone separator that separates the coal and gangue material as from the gas stream. Ordinarily the particles of coal and the gangue material, such as clay, will be in the range of about 0 to 20 microns in size. The coal-containing bottoms is sent via conduit 27 to be picked up by an airstream and burned in a combustor 29 to form the hot gases being used in the updraft dryer 17. Supplemental or alternate fuel may be employed if desired.

The gases from the separator 25 pass on to vent. If desired, the gases may be sent to a scrubber 31 and washed to chemically remove the sulfur oxides before being vented. This is particularly vital in populated areas or where pollution controls make this mandatory. A wide variety of materials may be employed to scrub the sulfur oxides from the gases. These materials range from caustic solutions such as sodium hydroxide, sodium carbonate, to the amenes such as diethylnol amene, triethanolamine. These scrubbing processes are commercially available, well documented and need not be described in detail herein. It is sufficient to note that the liquid scrubbing material is circulated over beds or trays or sprayed to contact the gases and remove the noxious pollutants. The liquid may be periodically regenerated or recharged with new materials depending upon its nature. The beds in the tower, or scrubber 31 may be Raschig rings, Beryl Saddles, or the like; or sprays may be used instead.

The particles of coal and gangue material that have collected in the hopper 19 may be sent to hot storage 33 by way of suitable conveyor means 35. As indicated by the two way flow symbols along the conveyor **35*a*, the material may go into or from hot storage as necessary to make up and keep the proper charge being fed to the thermal-chemical reactor 37. Alternatively, the material may go into hot storage 33, be retained therein for a time, then go by conveying means 35*b* to the reactor 37**.

The dryed coal product from the updraft dryer is kept at its elevated temperature; for example, in the range of 225° F. to 275° F. If desired, it is protected from contact with air by an atmosphere of an inert gas such as nitrogen or carbon dioxide. The inert gas is used in the transportation or isolation of the hot coal to prevent possible oxidation or explosion. In any event, the hot coal is fed directly into the agitated reactor with the alcohol coal slurry therewithin to contact the cool alcohol and accelerate comminution by adding thermal shock to the other comminution forces. Make up alcohols **38*a* or 38*b* may be added to the hot coal before entry to the reactor 37** to increase the temperature difference, since the slurry temperature is around 150° to 170° Fahrenheit.

The conveyor lines 35 may be conduit having air or other gas being blown therethrough for entraining and carrying the coal; or they may be conventional conveyers such as screws, augurs, conveyer belts and the like.

The hot storage 33 may comprise any suitable storage such as an insulated building that will prevent inordinate escape of heat from a pile of coal that is stored therein. On the other hand, it may comprise conventional large hoppers with funnel shaped bottoms and screw conveyers to assist in ingress and egress of the hot coal. The hoppers will be insulated as by foam, fiberglass, spun glass, or glass wool on the exterior to reduce heat losses.

In the thermal-chemical reactor 37 or just prior to entry, the hot coal and gangue particles are admixed suddenly with cooler alcohol. By alcohol is meant the alcohol containing from 1 to 4 carbon atoms, inclusive. Individual alcohols, such as methanol, may be employed if desired. Ordinarily, however, it is economically advantageous to employ the mixed and relatively impure alcohols such as those formed by the oxo process or any of the processes documented in patents such as U.S. Pat. No. 4,030,893 for preparing the alcohol from coal by way of first preparing synthesis gas, or water gas followed by synthesis of the alcohols. The makeup alcohol is preferable at a temperature within the range of 35° F.-90° F.

In any event, the thermal shock is used to accelerate physical breakage and parting between dissimilar materials in the coal. This is done economically by maintaining coal at an elevated temperature, as implied hereinbefore and then feeding the hot coal into the reactor vessels with the cool alcohols at a controlled lower temperature. Preferably there is agitation in the reactor to add the effects of impact, abrasion, hydraulic shock and chemical comminution to the thermal shock to effect both partical size reduction and the freeing of discreet particles of gangue materials from the carbonaceous materials.

During the drying of the coal in the hot carbon dioxide gases in the updraft dryer, carbon dioxide is adsorbed. It is desorbed in the reactor. The hot carbon effects boiling of some of the lower alcohols and carbon dioxide is evolved along with the alcohol vapors in the reactor. The rapid evolution of carbon dioxide gas can be seen and indicates a very violent replacement of these molecules on and within the carbonaceous particles in the slurry. This molecular replacement assists in effecting comminution of the carbonaceous materials and freeing of the gangue materials therefrom.

From the foregoing, it can be seen that there are thermal and physical-chemical spontaneous comminution effects that take place in the reactor and reduce the power required to comminute the particles to the surprisingly small size effected in accordance with this invention. Preferably, the thermal-chemical reactor 37 also employs at least one in-line series of stationary and moving impellers to effect comminution of the particles in alcohol in order to get as many of the particles to minus 100 microns size as practical.

The slurry of the particles of coal and gangue materials is passed from the thermal-chemical reactor 37 to the screen 39.

If desired, as indicated by the dashed line 41, a specific fraction of firm, undisturbed coal particles that are of high quality may be sent directly to storage at this stage. These coal particles will have a size within a predetermined range of from about ⅜ in to about 1/20 inch (−10 mesh). This is effected by having a particular screen or section of the screen that will screen out these particle sizes. If desired, the particle sizes may be very narrow as by about ⅜ inch by about ¼ inch range.

Ordinarily, however, the coal particle sizes in the oversize will be ground and returned to the thermal-chemical reactor. Specifically, if 1/20 size is desired as the cut off, about a 10 mesh screen may be employed and the over size sent to grinder 43. It is preferred that the oversize above about +4 mesh to be ground and returned to the reactor 37. The grinder 43 will be selected to handle the relatively small particle size. The grinder 43 may comprise rod mills, ball mills, pebble mills, counter rotating pin mills or cage mills or even high intensity in line blenders, (or shear machines). In any event, the large particles are separated so as to be subjected to the physical-chemical effects in the reactor 37 when passed therethrough again.

The major part of the slurry will pass through the screen and be sent by a suitable conveying line to an enclosed comminutor 47.

With certain coals, it may be desired to employ a combination thermal-chemical reactor 37 and enclosed comminutor 47 so the flow is along the lines indicated by the dashed arrow 49 without requiring intermediate screening on screen 39, grinding on grinder 43 and return to the thermal-chemical reactor 37. The conveyor lines 45 will ordinarily be a series of pumps, designed to handle the slurry of coal particles, gangue particles, and alcohol, with enclosed conduits for pumping into the enclosed comminutor 47.

Comminutor 47 is preferably a ball mill, pebble mill, or the like to effect reduction of the particle sizes to minus 100 micron size. If experience indicates that the comminution is effective, the screening may be dispensed with and the effluent sent directly by a suitable conduit 51 to a velocity separator. On the other hand, if there are problems with the comminution, the discharge stream may be sent to a screen 53 where the same screening options are available as described hereinbefore with respect to screeen 39. Specifically, the options are to screen out a specific range of particle sizes from ⅜ inch to 1/20 inch (−10 mesh) and send directly to storage; take an oversize above a predetermined maximum and return it via conduit 55 to the enclosed comminutor for further reduction in size; and take the material passing through the screen and send it via conduit 56 and conduit 51 to the settling velocity separator 57.

In any event, the settling velocity separator 57 makes use of the relative difference in settling velocity between the carbonaceous particles and the gangue material particles to effect the separation into an overflow stream containing the minus 100 micron size high quality carbon particles; for example, of minus 100 micron to 0 micron size, which will be primarily particulate coal. This material is transferred directly to product storage as a dilute slurry. This slurry can be concentrated and employed directly as fuel since it contains totally combustible material such as the coal and alcohol with very little of the ash forming gangue materials and very little of the pollutants. If desired, the more expensive alcohol can be recovered before usage. The alcohol can be recovered by evaporation or any other conventional means, as described later hereinafter with respect to alcohol recovery unit 77. The settling velocity separator may be a quiescent type separator in which laminar flow allows the denser particles to settle from the slurry; or it may be a cyclone separator, or a centrifuge employing the accelerated settling velocity principle for separation. As can be seen in FIG. 2, the settling velocity of the gangue material is much greater than that of the coal of the same particle size and so is separated readily therefrom. Serendipitously, it has been found that the chemical-physical processes taking place between the alcohols and the particulate materials generally effect a significant eduction in the effective specific gravity, or density of the individual coal particles. One of the reasons is that the coal particles were separated from the more dense gangue materials. This reduction may be as much as 10 percent or more from the original specific gravity of the coal. The specific gravity of coals may range from extremes of about 1.1 for lignites to about 1.8 for very dense anthracites; but most of the coal will be in a gravity range of from 1.2 to 1.5. The gangue materials, on the other hand, will have a specific gravity generally in the range of about 3.5 to 5.

As the specific gravity of the coal particles is reduced, the density of the liquid medium is increasing by solution of materials from the coal and by colloidal size particles going into suspension in the liquid. The effective viscosity of the slurry is also increasing as more materials go into suspension and solution. The combined effect of these factors as well as the particle shape factors tend to reduce the settling velocity of the carbonaceous particles to very low levels compared to most of the gangue materials of comparable particle size, or mean diameters. Thus a relatively large carbonaceous particle may exhibit a lower settling velocity than a smaller particle of pyrite, chalcopyrite, silica, limestone and the like.

In any event, the underflow from the velocity separator 57 will contain the high settling velocity gangue materials, some larger coal particles, and is super saturated with fluid containing some of the low settling velocity particles. The underflow is passed by conduit 61 to the dilution vessel 63 where additional alcohol is added to help effect selective comminution in the selective comminutor 67. The degree of dilution is one factor that can be controlled to assist in getting the desired result. Less dilution requires dependence more on hydraulic shear factors. If there is more dilution, the selective comminution will depend more on physical impact.

The degree of dilution may be to form a mixture ranging in proportion from 50 percent solids and 50 percent liquids in the slurry, to as much as 75 percent of liquids being employed; the percents being by weight. In any event, the admixture of the diluted particles in the slurry is sent by way of conduit 65 to the selective comminutor 67.

The selective comminutor 67 will have been carefully selected based on experimental tests for the type of coal to be processed. Rather wide variations may be expected for different types of coal or from coal from different seams or areas. The principle objective is to effect size reduction of the carbonaceous particles with as little reduction in the size of the gangue materials as possible. Several conventional types of equipment may be useful in this selective size reduction, depending upon the coal. High intensity, in-line blenders (or shear machine) may be employed. Counter-rotating pin mills or cage mills may be employed. Rod mills, ball mills, or pebble mills may be employed. The various types of roll mills may be employed. Particularly useful are the roll mills with rollers of a predetermined hardness and settable with predetermined openings. For example, the polyurethane coated rollers may be employed to crush the carbonaceous material but not the gangue material.

In any event, the particle size are reduced and the dilute slurry is pumped via conduit 69 to another separator 71. Preferably, the separator 71 is a settling velocity type separation device such as a cyclone separator, centrifuge, or a quiescent zone settling velocity separator. The separation may be made at about 50 microns for carbonaceous material particles or at smaller particle size range if necessary to obtain good quality product. The overflow fraction is sent by way of conduit 73 to the storage area for storage as a dilute slurry of carbonaceous material, or coal particles. Because of the small particle size, this dilute slurry of carbonaceous material may be particularly efficacious for certain applications such as burners that have been converted from burning a liquid or gaseous fuel to burn the slurry of the carbonaceous material in alcohol. The slurry burns with hot flame and low pollution. The underflow from the separator 71 will consist of the gangue materials such as clay, rock minerals, inorganic sulfur-bearing materials, trace minerals and some carbonaceous material. Ordinarily, the underflow will be primarily a waste product that is discarded back to the mine pit eventually. In certain instances there may be as much as 10 to 50 percent coal particles included. In any event, the underflow is passed by conduit 75 to an alcohol recovery unit 77 where the alcohol is recovered.

The alcohol recovery unit 77 may comprise a plurality of evaporators and condensers, with or without distillation columns for separating the valuable by-products. If only the liquor comprising the alcohol is desired to be recovered, the evaporators may evaporate by applying heat to the slurry to allow the alcohol to come off and leave the dry gangue materials containing coal dust and the like as noted hereinafter. In like manner, as noted hereinafter, various distillation columns with draw-off points at one or more trays may be employed for separating the constituents that have been dissolved in the alochol. If desired, solvent extraction may be employed to pull one or more of the constituents from the alcohol liquor into another stream before being separated by distillation, adsorption, or any of the other separation means conventionally employed. The degree of elaborateness of the alcohol recovery unit will depend upon the coal and initial raw materials contained therewithin, the solution characteristics of the materials in the alcohol being employed, and the market at any given time. The alcohol is sent to alcohol storage by way of conduit 81. The gangue material is passed by conveyor lines 83 to its ultimate depository. This ultimate repository may be back into the mine, as indicated; or it may be to a storage pile if the bottom contains enough carbon to combust economically. When employed in a combustor such as combustor 29, special provisons are made to handle the high ash content and the sulfur oxide emissions.

With certain coals, such as lignites, the process may be varied somewhat as follows. If the carbon particles are reduced by settling velocity separation such that the maximum particle size for carbon particles is about 100 microns, then the product (overflow) will contain carbon particles of from about 1 to 100 micron sizes. This product may contain an appreciable amount of very small gangue materials (1–20 microns). In this case, the first product may be separated again, for example into a stream containing 1 to 50 micron carbon particles. This new overflow then would contain no gangue materials larger than about 4 or 5 microns. The new underflow would contain carbon particles from 50 to 100 microns and most of the gangue materials. This can be selectively comminuted, then separated again into product containing 1 to 50 micron carbon particles and underflow containing +50 micron carbon particles and the gangue material.

In general the products from the process or portion of the process herein may be recycled through any series of steps as necessary to achieve the results delineated herein. The products which come from the separation processes described hereinbefore as dilute slurries of small particle size carbonaceous material in alcohols, soluble materials dissolved in alcohol and colloidal particles of material in suspension may be further processed in various ways to produce high quality suspensiod coal-alcohol fuels such as described in the aforementioned U.S. Pat. No. 4,045,092. On the other hand, as indicated hereinbefore, the respective ingredients may be separated, as by evaporation and condensation of the alcohol, to form high quality, dry, particulate carbonaceous fuel with all of the alcohol removed and the alcohol as separate streams. If desired, the products may be separated by heating under superimposed pressure to temperatures of at least 180 degrees Fahrenheit (° F.) above ambient to as much as 600° F. to 800° F. above ambient, followed by single stage flashing to remove all of the alcohols plus intermediate hydrocarbons and other volatilizable materials (including some organic sulfur-bearing compounds) to produce a low-density, high-porosity, high permeability, highly reactive very small particle size, dry carbonaceous-hydrocarbonaceous fuel, termed CHC fuel, and described in the aforementioned U.S. Pat. No. 4,030,893.

The CHC fuel process may also produce very small particle size and colloidal particle size carbonaceous materials mixed with hydrocarbon and alcohol as a by-product. This unique lowcost fuel may be used as fuel for gas turbines or combined cycle power plants. It may also be used as a fuel oil extender and even as a diesel engine fuel extender. It will be recovered from the first stages of a sequential condensing system where the small particle size materials will be collected and removed along with the first formed condensate droplets.

Intermediate particles of the CHC fuel may be produced by settling velocity separation of particles in a dry gas after flashing to vaporize the volatilizeable materials. The CHC fuel may be separated at the desired particle settling velocity into; for example, a plus (+) 10 micron fractionand a minus (−) 10 micron fraction. The (−)10 micron fraction can be employed as an additive to diesel engine fuels, can be added to combustion fuel oil for gas turbine fuel or combined cycle power plant fuel oil, or used for direct combustion in boilers. A variety of useful by-product materials and chemicals may be produced from the alcohols used in the reactor and subsequent comminution and separation processes, if these liquids are removed by centrifuging and rewashing with clean alcohols prior to separation of the alcohols and the carbonaceous particulate material; or prior to processing to prepare the high quality suspensoid of coal in alcohol fuel (referred to as METHACOAL).

Partial recovery of the soluble materials may be effected by simply recovering a portion of the alcohol by thickeners or centrifuges prior to further product processing. These alcohols solutions may then be processed by conventional distillation or other means to recover the soluble materials dissolved from the coal or lignite.

The sequential condenser used to recover the alcohols for subsequent reuse or for such other uses as described hereinbefore, can also recover selectively the hydrocarbons and other volatilized compounds that condense out of the vapor state at temperatures greater than the condensation temperature of the alcohol.

The noncondensable gases exiting the condensers may or may not contain materials sufficiently valuable to justify recovery. They may also contain sulfur oxide or other pollutants which must be removed prior to exhausting the gases to atmosphere or burning them as fuel.

From the foregoing descriptive material, it can be seen that this invention achieves all of the objects delineated hereinbefore. Specifically, it provides a method of removing gangue material from coals that is economical, universally applicable to all coals; does not require significant amounts of alcohol to be left remaining in the particulate streams such as the gangue material; provides for removal of much smaller particles of diluent, or gangue materials; and effects removal of some of the organic sulfur-bearing compounds from high quality fuel products produced. Because of the small sizes of the particles involved, this product has special usefulness that should allow upgrading the quality and price of the products because the products are more valuable to the end user.

Having thus described the invention, it will be understood that such description has been given by way of illustration and example and not by way of limitation, reference for the latter purpose being had to the appended claims.

What is claimed is:

1. A method of removing gangue materials from coals, including lignites, to provide high quality carbonaceous fuel and valuable byproducts comprising the steps of:

a. comminuting the coal by physical impaction, screening the coal, and recycling the coal to provide particulate coal no larger than $\frac{3}{8}$ inch particle sizes; simultaneously forming fine coal and platy gangue particles of about 1–20 micron particle size;

b. drying said particulate coal by an updraft of hot gases that entrains said particulate coal, heats it to an elevated temperature and carries it overhead;

c. separating the hot dried particulate coal and taking the hot gases and the fine coal and platy gangue material as overhead;

d. separating from the overhead the fine coal and platy gangue materials for a fuel for generating the hot gas for said drying of step b;

e. storing the hot dried coal at its elevated temperature;

f. admixing said hot dried coal at its elevated temperature in an enclosed vessel with a cooler alcohol containing 1–4 carbon atoms, inclusive, to provide the thermal shock; and comminuting in said closed vessel;

g. withdrawing and additionally comminuting said coal particles in the alcohol slurry to sizes having a majority of particles of minus 100 micron size;

h. separating said slurry of comminuted said particles by settling velocity methods into an overflow containing the fine high quality carbon and sending it to storage; and into an underflow containing high settling velocity gangue materials that are in thickened slurry with fluid containing some low settling velocity particles;

i. diluting the underflow of coarse high density coal and gangue materials with said alcohol;

j. selectively comminuting to breakdown the coarse coal with relatively little breakage of the gangue material, which is more durable than said coal;

k. separating the particles from step j. into an overflow containing the high quality carbon product that can be sent to storage; and an underflow of unwanted gangue materials containing 10–50 percent by weight of said coal and said alcohol; and l. recovering said alcohol from the admixture of the unwanted gangue materials and the coal.

2. The method of claim 1 wherein said high quality coal product of step k is used directly as a fuel.

3. The method of claim 1 wherein the high quality coal products of step k is separated into solid and liquid phases that are recovered for use.

4. The method of claim 1 wherein said unwanted gangue materials containing 10–50 percent by weight of coal is employed as the fuel, for drying.

5. The method of claim 1 wherein said admixed said dried coal at its elevated temperature in said cooler alcohol is comminuted in the closed vessel in the presence of evolved gases comprising one of carbon dioxide and methane.

6. The method of claim 1 wherein the additionally comminuted coal in the alcohol slurry in accordance with step g. is thereafter screened to recover as a product a durable coal having sizes smaller than about $\frac{3}{8}$ inch but larger than about 1/20 inch and useful directly as high quality carbonaceous product.

7. The method of claim 6 wherein said coal particle sizes are screened to have a size range of from $\frac{3}{8}$ to $\frac{1}{4}$ inch and form a uniformly sized fuel of high quality coal.

8. A method of removing gangue materials from coals, including lignite, to provide high quality carbonaceous fuel and valuable by-products comprising the steps of:

a. comminuting and screening the coal and gangue materials until the particles are all smaller than 10C microns; forming gangue particles of greater sphericity and density than the coal particles;

b. forming a slurry of the −100 micron particles of coal and gangue material in alcohol having 1–4 carbon atoms, inclusive;

c. separating by settling velocity separation the gangue materials having the greater sphericity, greater density and higher settling velocity from the coal particles leaving high quality carbonaceous products; and d. recovering the alcohol from the gangue materials.

9. The method of claim 8 wherein said comminuting of step a. is carried out in the presence of said alcohol to reduce the power required for comminution, to effect greater physical parting and separation of the carbonaceous particle from the gangue particles and to effect greater reduction in density and terminal settling velocity of the carbonaceous particles.

10. The method of claim 9 wherein the gangue materials from step c. of claim 8 is separated as an underflow and is subjected to at least one partial cycle comprising:

a. selectively comminuting at controlled intensity and limited impact comminution in the alcohol slurry state with controlled dilution to preferentially reduce the carbonaceous particles to a greater degree than the gangue materials; and b. separating by settling velocity separation the product from the selective comminution into a product stream of predominantly carbonaceous particulate material and an underflow stream comprising mostly gangue materials; and wherein the alcohol is recovered from said gangue materials.

11. The method of claim 8 wherein said comminuting of step a. is carried out by a multi-step process comprising:

a. crushing and screening the particles of coal and gangue material to form particles of less than ⅜ inch size for drying;

b. drying said particles to a predetermined moisture content of less than one percent by weight of water in the coal and gangue materials;

c. separating the particles of platy gangue materials and coal dust of sizes in the range of about 1–20 microns, inclusive, for use as a fuel; and d. comminuting the remaining particles of coal and gangue materials to the minus 100 micron size range desired.

12. The method of claim 11 wherein said comminution of step d. is carried out in the presence of said alcohol to reduce the power requirements for comminution, to effect greater physical parting and separation of carbonaceous particles from the gangue particles, and to effect greater reduction in the density and terminal settling velocity of the carbonaceous particles.

13. The method of claim 11 wherein said drying of step b. is carried out by heating said particles of coal and gangue material to a first predetermined temperature $t_1$ within the range of 225° F.–275° F. and said particles are maintained in said range until admixed with said alcohol in accordance with step b. of claim 8 and said alcohol is maintained at a second temperature $t_2$ within the range of 35° F.–90° F. and admixing the hot said particles and the cold said alcohol such that there is thermal shock that is additive with the other comminution effects to accelerate comminution.

14. Method of claim 13 wherein the gangue materials from step c. of claim 8 is separated as an underflow and is subjected to at least one partial cycle comprising:

a. selectively comminuting at controlled intensity and limited impact comminution in the alcohol slurry state with controlled dilution to preferentially reduce the carbonaceous particles to a greater degree than the gangue materials; and b. separating by settling velocity separation the product from the selective comminution into a product stream of predominantly carbonaceous particulate material and an underflow stream comprising mostly gangue materials; and wherein the alcohol is recovered from said gangue materials.

15. The method of claim 11 wherein the gangue materials from step c. of claim 8 is separated as an undeflow and is subjected to at least one partial cycle comprising:

a. selectively comminuting at controlled intensity and limited impact comminution in the alcohol slurry state with controlled dilution preferentially reduce the carbonaceous particles to a greater degree than the gangue materials; and b. separating by settling velocity separation the product from the selective comminution into a product stream of predominantly carbonaceous particulate material and an underflow stream comprising gangue materials; and wherein the alcohol is recovered from said gangue materials.

16. The method of claim 8 wherein said slurry of said coal and gangue materials in said alcohol formed in step b. is screened before step c. and an oversize fraction of particles greater than 100 microns in size is collected.

17. The method of claim 16 wherein said oversized fraction is recycled back to be further reduced in size.

18. The method of claim 16 wherein said oversize fraction contains coal within a particle size range of ⅜ inch- 1/20 inch and is sent directly to product storage.

* * * * *